US005333655A

United States Patent [19]

Bergamini et al.

[11] Patent Number: 5,333,655

[45] Date of Patent: Aug. 2, 1994

[54] SYSTEM FOR EFFECTIVE VAPOR RECOVERY WITHOUT SEAL MEMBERS IN FUEL FILLING INSTALLATIONS

[75] Inventors: Giorgio Bergamini; Ernesto Paris, both of Bari, Italy

[73] Assignee: Nuovopignone Industrie Meccaniche e Fonderia SpA, Florence, Italy

[21] Appl. No.: 945,222

[22] Filed: Sep. 15, 1992

[51] Int. Cl.[5] ..... B65B 3/18

[52] U.S. Cl. ..... 141/59

[58] Field of Search ..... 141/59, 44–46, 141/301, 286, 83; 137/587–589; 55/387, 88

[56] References Cited

U.S. PATENT DOCUMENTS

| | | | |
|---|---|---|---|
| 4,095,626 | 6/1978 | Healy | 141/59 X |
| 4,197,883 | 4/1980 | Mayer | 141/59 |
| 4,202,385 | 5/1980 | Voelz et al. | 141/59 |
| 5,038,838 | 8/1991 | Bergamini et al. | 141/59 |
| 5,040,577 | 8/1991 | Pope | 141/59 |
| 5,156,199 | 10/1992 | Hartsell, Jr. et al. | 141/83 |
| 5,172,738 | 12/1992 | Komukai et al. | 141/83 |
| 5,195,564 | 3/1993 | Spalding | 141/1 |

FOREIGN PATENT DOCUMENTS

| | | |
|---|---|---|
| 0460864 | 5/1991 | European Pat. Off. . |
| 0461770 | 5/1991 | European Pat. Off. . |
| 9110431 | 5/1991 | Fed. Rep. of Germany . |
| 4038579 | 11/1992 | Fed. Rep. of Germany . |

*Primary Examiner*—Ernest G. Cusick
*Attorney, Agent, or Firm*—Morgan & Finnegan

[57] ABSTRACT

A system for vapor recovery in fuel filling installations without the use of seal members between the delivery gun and the filler pipe of the vehicle to be refuelled, comprising control means which in response to electrical signals indicative of the volumetric fuel delivery rate render the volumetric draw-in rate of said recovery means always greater than said volumetric fuel delivery rate; a preferred embodiment of said control means is also described.

2 Claims, 2 Drawing Sheets 7
15
1
16
13
12
14
21
11
3
19
9
20
18
17
30
4
10
5
6
8
16
2

SYSTEM FOR EFFECTIVE VAPOR RECOVERY WITHOUT SEAL MEMBERS IN FUEL FILLING INSTALLATIONS

This invention relates to a new system for vapor recovery in fuel filling installations which, without using seal members between the delivery gun and the filler pipe of the vehicle to be refuelled and in-drawing a vapor flow rate which is always greater than the volumetric flow rate of the delivered fuel by not less than 5% and not more than 25% thereof independently of possible further increase in the in-drawn flow determined by the difference between the temperature of the in-drawn vapor and the temperature of the fuel contained in the underground tank, results in considerable efficiency without the need for further specific recondensation and/or separation devices.

More specifically, the invention represents an improvement in the vapor recovery system of the preceding U.S. patent application Ser. No. 07/888 560 filed on 22 May 1992 by the present applicants. As is known from that application, on delivering the fuel an excess of vapor is created in the vehicle tank to be filled because of the turbulence of the liquid jet leaving the gun at high delivery speed, i.e., the inevitable violent impact of the delivered fluid against the walls of the filler pipe and tank, and its mixing with the residual fuel contained in the tank, this giving rise to the creation of numerous very minute bubbles and foam which, by increasing the heat transfer area, result in increased evaporation which is currently compensated by increased draw-in by the positive displacement pump to a rate equal to the maximum predictable excess, together with appropriate optimization of specific devices for vapor recondensation and/or air separation from the vapor.

It has now been experimentally found that by making the pump draw in a volumetric vapor flow rate which is always greater than the volumetric flow rate of the delivered fuel by not less than 5% and not more than 25% thereof, ignoring any temperature compensation, a high system efficiency is achieved even without using the specific recondensation and/or separation devices, with consequent considerable plant simplification and evident cost reduction. In this respect, if the in-drawn flow rate is greater by less than 5%, only a minimum part of the effective vapor excess created is captured, most of this latter being irredeemably lost through the free opening of the filler pipe. On the other hand if the indrawn flow rate is greater by more than 25%, there is inevitably a considerable vapor loss into the atmosphere through the vent of the underground tank, this latter not being able to contain such an excess vapor accumulation.

Hence, the system for effective vapor recovery without seal members in fuel filling installations, comprising fuel delivery means of variable volumetric delivery rate, measurement means for providing electrical signals indicative of said volumetric delivery rate, and vapor recovery means of adjustable volumetric draw-in rate consisting substantially of a pipe for returning vapor from the delivery gun, when inserted into the filler pipe of the motor vehicle to be refuelled, to the underground tank of the installation via a vapor draw-in member, is characterised according to the present invention by comprising control means which in response to said electrical signals render the volumetric draw-in rate of the recovery means always greater than the volumetric delivery rate of the fuel delivery means.

According to a preferred embodiment of the present invention, the measurement means provide electrical signals in the form of pulses, the frequency of which is indicative of the variable volumetric delivery rate provided by the delivery means. According to a further characteristic of the present invention, the control means render the volumetric draw-in rate of the vapor recovery means always greater than the volumetric delivery rate of the fuel delivery means by between a minimum of 5% and a maximum of 25% thereof.

According to a further preferred embodiment of the present invention, the vapor draw-in member is a positive displacement pump operated by an electric motor.

Finally, according to a further preferred embodiment of the present invention, the control means consist of a pulse converter which is fed at its input by the electrical pulses of frequency proportional to the variable volumetric delivery rate provided by the measurement means, to give at its output a corresponding series of electrical pulses having the same frequency but of constant but adjustable set duration, which are fed to the input of an operational unit which at its output provides their mean value, i.e., provides an analog quantity which varies with the frequency and is hence indicative of the volumetric rate of delivery of the fuel delivery means, this being fed as first input signal to a comparator together with a second analog signal indicative of the speed of rotation of the positive displacement pump drive motor and hence indicative of the volumetric flow rate of the in-drawn vapor, the output of the comparator being fed to the control unit of the motor to maintain the motor speed constant when the two input signals to the comparator are or equal value and to increase or reduce the speed when said first signal is respectively greater or less than the second signal. The advantages of such control means are immediately apparent. Firstly, by the effect of the pulse converter, a mean value is obtained which always varies on the basis of the frequency of the input pulses and is hence indicative of the volumetric delivery rate even when the input pulses, as is generally the case in reality, have a duration inversely proportional to the frequency and hence present a mean value which remains constant as the frequency varies, this enabling the system to operate with analog signals which allow considerable constructional simplification and consequent cost reduction. Again, the volumetric flow rate of indrawn vapor is made greater than the volumetric delivery rate of the fuel by simply increasing the duration of the output electrical signals from the converter by suitably controlling this latter. In this respect, this correspondingly increases the mean output value of the operational unit with the result that, by the effect of said comparator the speed of the motor is correspondingly increased to result in a correspondingly greater vapor draw-in by the relative positive displacement pump. The invention is described in greater detail hereinafter with reference to the accompanying drawings, which illustrate a preferred embodiment thereof given by way of non-limiting illustration in that technical or constructional modifications can be made thereto without leaving the scope of the present invention. For example the desired increase in the volumetric flow rate of the in-drawn vapor over the volumetric fuel delivery rate can be obtained not by varying the duration of the output pulses from the converter, but instead by acting on the two analog signals at the converter input in the sense of suitably amplifying said first signal and/or attenuating the second signal.

In the drawings:

FIGS. 3 to 5 show the corresponding wave forms of the electrical signals present in the block scheme of FIG. 2, of which:

FIG. 3 shows the wave form of the electrical pulse signal generated by the measurement means for the volumetric fuel delivery rate:

FIG. 4 shows the wave form of the converter output signal;

FIG. 5 shows the wave form of the analog output signal from the operational unit.

Figure 1:
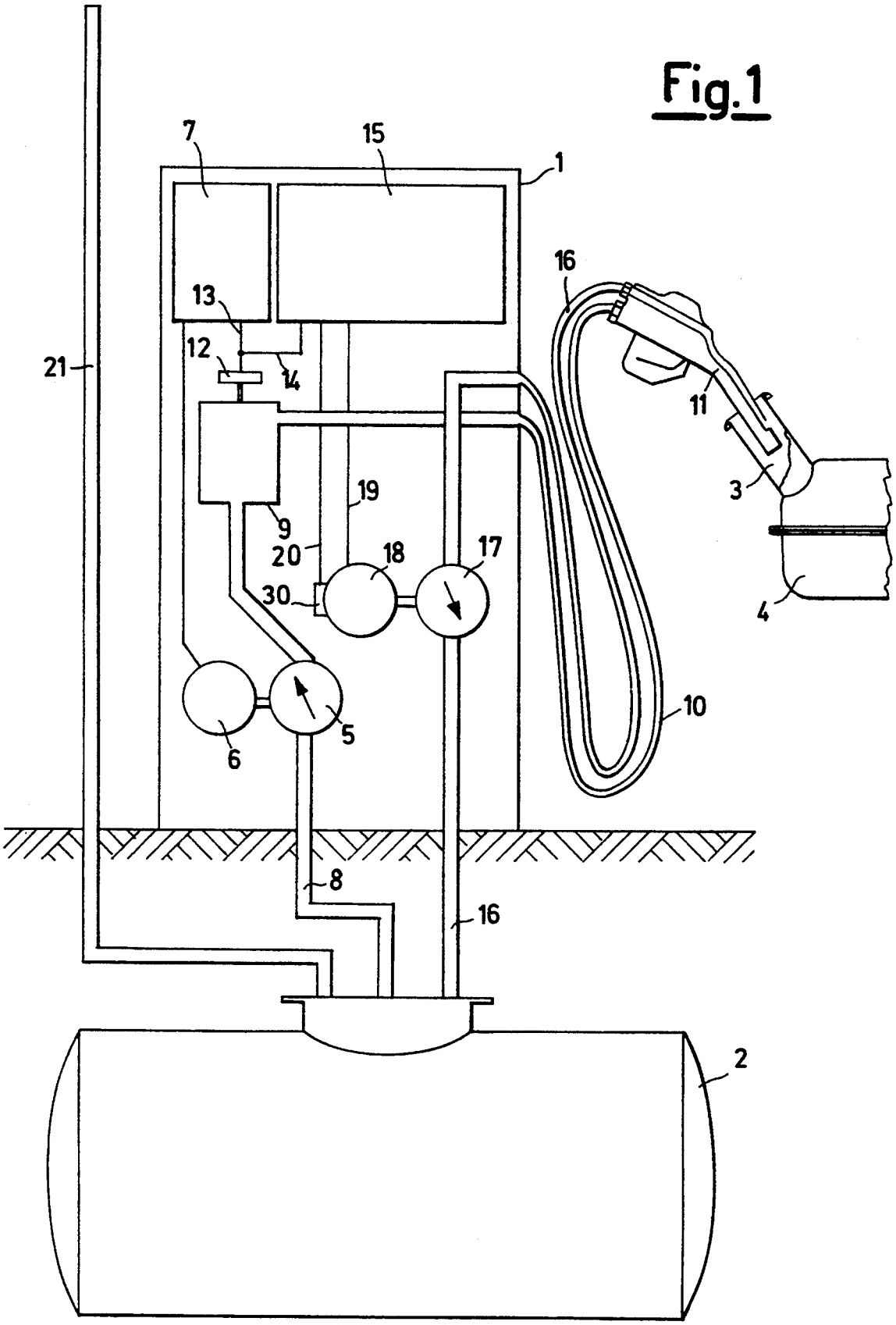
FIG. 1 is a sectional schematic view of a fuel filling installation using the vapor recovery system according to the invention.
Figure 2:
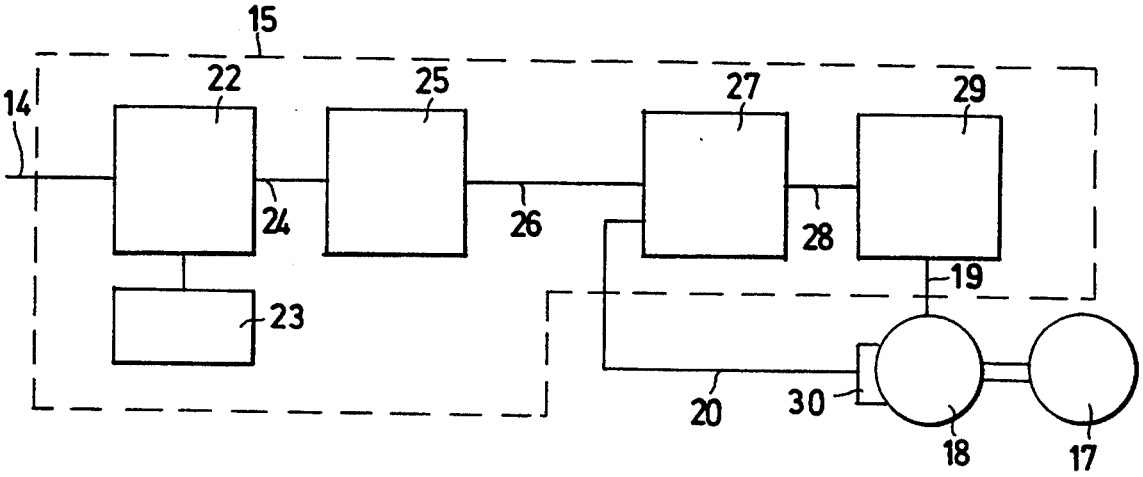
FIG. 2 is a block scheme showing the means for controlling the volumetric flow rate of the in-drawn vapor used in FIG. 1.
Figure 3:
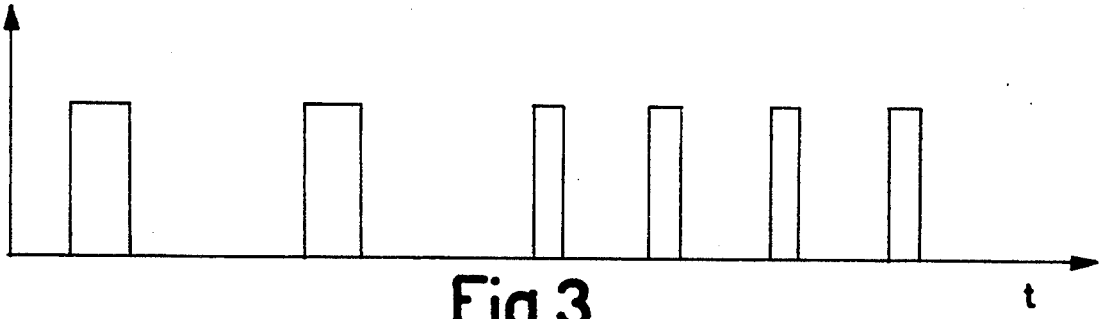
Figure 4:
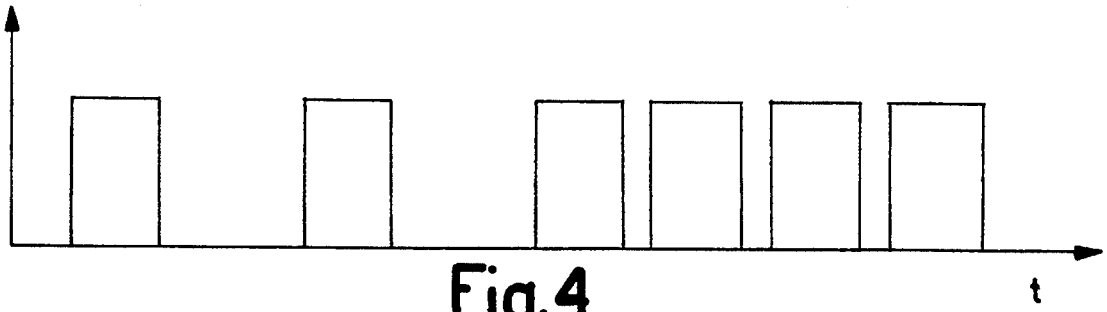
Figure 5:
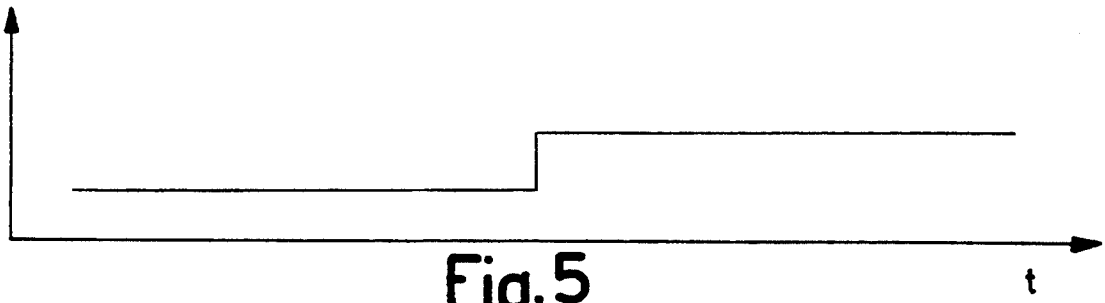

In the figures, the reference numeral 1 indicates the pumping column of a fuel filling installation and 2 the underground tank of the installation, the fuel of which is conveyed into the filler pipe 3 of the tank 4 of the vehicle to be refuelled by fuel delivery means of variable volumetric delivery rate consisting substantially of a feed pump 5 driven by an electric motor 6 controlled by the counter unit 7, to draw the fuel through the feed pipe 8 and convey it via the volumetric flow meter 9 to the delivery pipe 10 provided with a delivery gun 11. The flow meter 9 operates measurement means 12 which feed electrical pulse signals the frequency of which is indicative of the variable volumetric delivery rate of the fuel delivered, these signals being fed to the counter unit 7 via the cable 13 and to the control means 15 via the cable 14. The delivery gun 11 is provided with a pipe 16 for the return of vapor from the filler pipe 3 to the underground tank 2 and forming part of vapor recovery means of adjustable volumetric draw-in rate comprising also a vapor draw-in member consisting of a positive displacement pump 17 driven by an electric motor 18 controlled by the control means 15 via cables 19 and 20, such that the pump always draws in a volumetric vapor flow rate which is at least 5% greater than the volumetric delivery rate of the fuel delivered. FIG. 1 also shows the vent pipe 21 of the underground tank 2. Finally, the control means 15 comprise a pulse converter 22 with pulse duration regulator 23, receiving at its input via the cable 14 the electrical pulses indicative of the variable volumetric delivery rate of the fuel delivered which are supplied by the measurement means 12 and shown in FIG. 3, in which it can be clearly seen that the pulse duration is inversely proportional to the pulse frequency. The output 24 of the converter 22, in which the signal shown in FIG. 4 is present, consisting of a corresponding series of electrical pulses having the same frequency as those of FIG. 3 but of constant duration as set by the regulator 23, is then connected to the input of an operational unit 25 which at its output 26 provides the analog signal shown in FIG. 5 representing the mean value of the input signal which, being proportional to the frequency of this latter, is therefore indicative of the volumetric delivery rate of the fuel delivered. The output 26 is therefore connected to an input of the converter 27, the output 28 of which is connected to the control unit 29 which, via said cable 19, controls the electric drive motor 18 for the positive displacement pump 17. Finally, the electric motor 18 is provided with a speed measurement device 30, the analog signal from which is fed to the other input of the converter 27 via said cable 20.

We claim:

1. A system for effective vapor recovery without seal members in a fuel filling installation that has a delivery gun for insertion into the filler pipe for a motor vehicle and which draws fuel from an underground tank, comprising fuel delivery means of variable volumetric delivery rate, measurement means for providing electrical pulses of a frequency proportional to said variable volumetric delivery rate, and vapor recovery means of adjustable volumetric draw-in rate having a pipe for returning to the underground tank vapor from the delivery gun when the delivery gun is inserted into the filler pipe of the motor vehicle to be refuelled, control means responsive to said measurement means electrical pulses to adjust the volumetric draw-in rate of said adjustable volumetric vapor recovery means to be always greater than the volumetric delivery rate of said fuel delivery means, said control means having a positive displacement pump, a pulse converter fed at its input by electrical pulses provided by said measurement means to give at the pulse converter output a corresponding series of electrical pulses having the same frequency as said measurement means electrical pulses but of equal and adjustable pulse duration, an operational unit responsive to said pulse converter electrical pulses, said operational unit generating a first output signal that is a mean value indicative of the volumetric rate of delivery of said fuel delivery means, a comparator responsive to said operational unit output signal, a pump drive motor for said positive displacement pump for generating a second analog signal indicative of the speed of rotation of said positive displacement pump and hence indicative of the volumetric flow rate of the drawn-in vapor, said second analog signal and said output signal being coupled to said comparator to generate a signal that is indicative of the difference between said second analog signal and said output signal, a control unit responsive to said comparator generated difference signal to maintain said pump drive motor speed constant when said two input signals to the comparator are of equal value and to increase and reduce said speed when said operational unit output signal is greater and less, respectively, than said second analog signal.

2. A system for effective vapor recovery as claimed in claim 1, characterized in that said control means render the volumetric draw-in rate of said vapor recovery means always greater than the volumetric delivery rate of said fuel delivery means by between a minimum of 5% and a maximum of 25% thereof.

* * * * *